US009748684B2

(12) United States Patent
Singer

(10) Patent No.: US 9,748,684 B2
(45) Date of Patent: Aug. 29, 2017

(54) PLUG CONNECTOR AND MATING CONNECTOR

(71) Applicant: ITT Manufacturing Enterprises LLC, Wilmington, DE (US)

(72) Inventor: Helmut Singer, Bad Ditzenbach (DE)

(73) Assignee: ITT MANUFACTURING ENTERPRISES, LLC, Wilmington, DE (US)

( * ) Notice: Subject to any disclaimer, the term of this patent is extended or adjusted under 35 U.S.C. 154(b) by 0 days.

(21) Appl. No.: 15/191,454

(22) Filed: Jun. 23, 2016

(65) Prior Publication Data

US 2016/0380376 A1 Dec. 29, 2016

(30) Foreign Application Priority Data

Jun. 24, 2015 (DE) ..... 10 2015 211 658

(51) Int. Cl.

| | |
|---|---|
| ***H01R 13/18*** | (2006.01) |
| ***H01R 13/08*** | (2006.01) |
| ***H01R 13/193*** | (2006.01) |
| ***H01R 13/631*** | (2006.01) |
| *H01R 13/11* | (2006.01) |

(52) U.S. Cl.

CPC ..... *H01R 13/18* (2013.01); *H01R 13/08* (2013.01); *H01R 13/193* (2013.01); *H01R 13/631* (2013.01); *H01R 13/111* (2013.01)

(58) Field of Classification Search

CPC ..... H01R 13/20; H01R 13/2421; H01R 12/89
USPC ..... 439/263, 675, 700, 848, 266
See application file for complete search history.

(56) References Cited

U.S. PATENT DOCUMENTS 2,269,314 A * 1/1942 MacDonald ..... H01R 13/193 439/682
2,567,727 A * 9/1951 Quackenbush ..... 403/326
3,275,970 A * 9/1966 Johanson ..... H01R 24/40 439/263
3,525,973 A * 8/1970 Kipnes ..... 439/353
(Continued)

FOREIGN PATENT DOCUMENTS

DE 946363 8/1956
DE 946363 B 8/1956
(Continued)

OTHER PUBLICATIONS

European search reported received in EP Application No. 16173672.3, dated Nov. 14, 2016; 8 pages.
(Continued)

*Primary Examiner* — Tulsidas C Patel
*Assistant Examiner* — Marcus Harcum
(74) *Attorney, Agent, or Firm* — Knobbe, Martens, Olson & Bear LLP

(57) ABSTRACT

Disclosed is a plug connector for positioning on a mating connector and for producing an electrically conductive connection. The plug connector comprises a guide means and a contact pin. The guide means is configured and positioned such that to produce the electrically conductive connection, contact bars of a contact socket of the mating connector can be guided by means of the guide means toward the contact pin, said contact bars encompassing the contact pin in a frictional engagement to establish electrical contact.

19 Claims, 4 Drawing Sheets

(56) References Cited

U.S. PATENT DOCUMENTS

| | | | | | |
|---|---|---|---|---|---|
| 3,845,453 | A * | 10/1974 | Hemmer | H01R 9/0518 | 439/578 |
| 4,781,611 | A * | 11/1988 | Leonard | H01R 12/82 | 439/259 |
| 5,514,001 | A * | 5/1996 | Szegda | H01R 13/193 | 439/259 |
| 5,601,443 | A * | 2/1997 | Stinsky | H01R 24/40 | 439/263 |
| 6,860,743 | B2 * | 3/2005 | Ekkul | H01R 31/06 | 439/263 |
| 7,357,657 | B2 * | 4/2008 | Wells | H01R 13/639 | 439/263 |
| 7,435,109 | B1 * | 10/2008 | Sugiura | H01R 13/2421 | 439/700 |
| 9,093,764 | B2 * | 7/2015 | Manahan | H01R 13/11 | |
| 2004/0137800 | A1 * | 7/2004 | Jing | H01R 13/2421 | 439/700 |
| 2010/0197173 | A1 * | 8/2010 | Tsunoda | H01R 12/714 | 439/700 |
| 2014/0057500 | A1 * | 2/2014 | Morinari | H01R 13/2421 | 439/700 |

FOREIGN PATENT DOCUMENTS

| | | |
|---|---|---|
| DE | 102012101709 | 9/2013 |
| WO | WO 2013/127533 | 9/2013 |

OTHER PUBLICATIONS

Examination Report dated Mar. 8, 2016, in German counterpart application No. 08250809DE; 5 pgs.

* cited by examiner

PLUG CONNECTOR AND MATING CONNECTOR

CROSS-REFERENCE TO RELATED APPLICATIONS

This application claims priority to German Patent Application No. 10 2015 211 658.1, filed Jun. 24, 2015, published as DE 10 2015 211 658 A1, which is hereby incorporated by reference in its entirety.

BACKGROUND

Field

The invention relates to a plug connector and a mating connector for producing an electrically conductive connection.

Description of Related Information

A socket contact for producing an electrical plug-and-socket connection is known from EP 1 763 110 B1. A contact element has at least one contact blade, arranged in the manner of a spring arm on the contact element. The contact blades extend toward one another and form contact points in the contacting region. A plug contact is inserted through an opening region into the socket contact. The insertion of the plug contact forces the contact blades outward resiliently against a normal contact force exerted by the spring-mounted assembly, contact is established between the contact point of each of the contact blades and the plug contact.

It is thus known that during a plug-in process, the associated contact point rubs along the entire plug-in length of a contact pin. This is accompanied by corresponding abrasion at the contact point, which necessarily results in an increase in volume resistivity of the plug connection. Environmental factors such as pollutants, moisture, heat, etc. further encourage erosion of the contact point and the contact pin.

It is therefore an object of the invention to improve on known contact systems.

BRIEF DESCRIPTION OF THE DRAWINGS

In the following, embodiments of the invention will be detailed, with reference to the set of drawings. The drawings show.

DETAILED DESCRIPTION OF ILLUSTRATIVE IMPLEMENTATIONS

Figure 1:
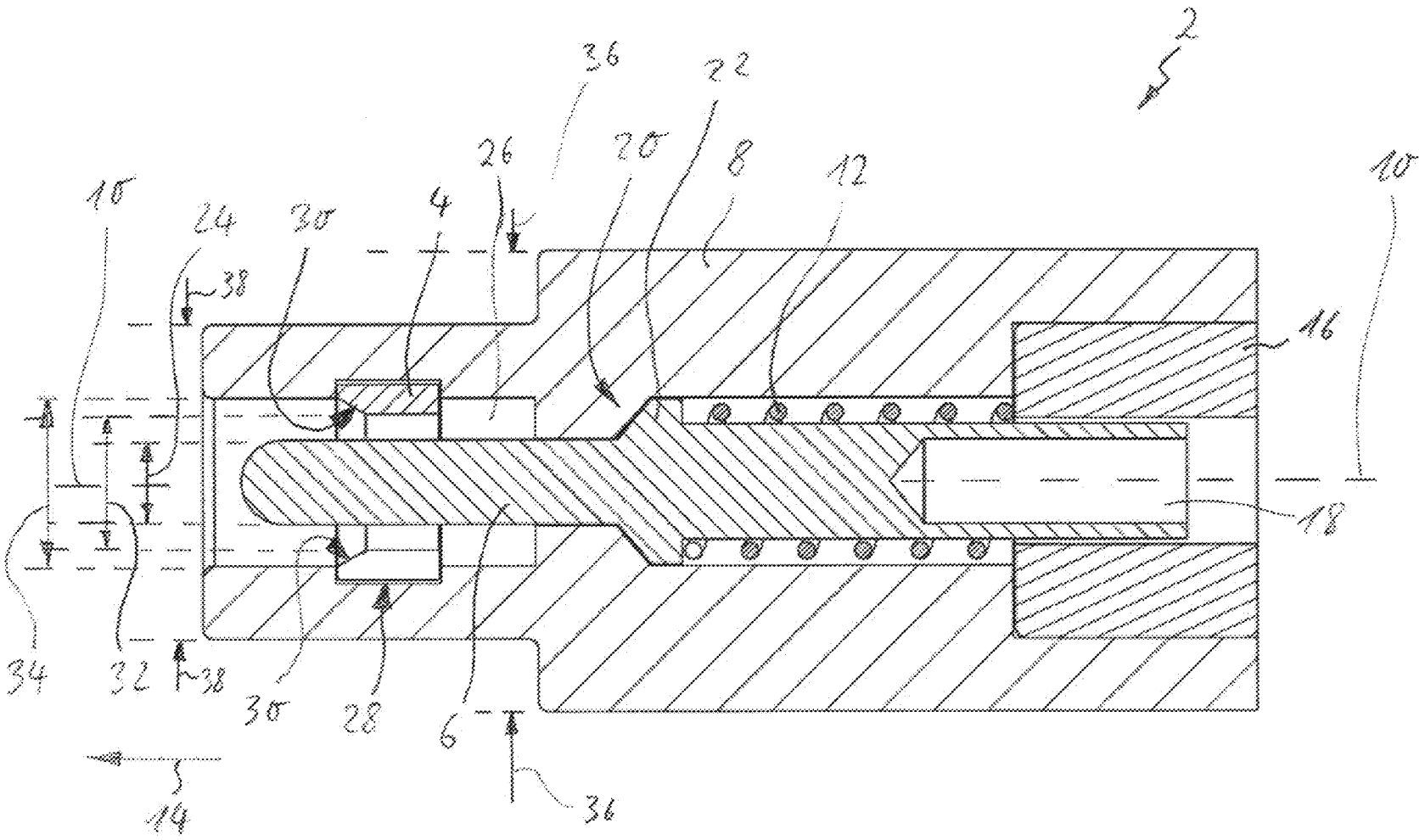
FIG. 1 a schematic cross-sectional view of a plug connector.

One or more objects of the innovations herein may be attained by a plug connector according to claim 1 and a mating connector according to claim 6. Advantageous enhancements are specified in the dependent claims. Features important to the invention are also contained in the following description and in the set of drawings, in which the features, both alone and in various combinations, may be important to the invention even if no explicit reference to this is made.

By configuring and positioning a guide means of a plug connector such that contact bars of a contact socket of a mating connector can be guided toward the contact pin to produce an electrically conductive connection, and such that said contact bars frictionally encompass the contact pin to establish electrical contact, regions of the electrical contact and regions where abrasion may occur are advantageously separated. This separation of the region where electrical contact is established from the region where the contact socket is guided advantageously enables the number of plug-in cycles to be increased and advantageously increases the resistance of the plug connector or of the mating connector to environmental factors. This results accordingly in a substantially constant contact resistance over the lifespan of the connector, since the contact resistance is not impacted by any abrasion that may occur in the region of the contact socket guide. Furthermore, the ability to withstand vibrations that may affect the plug connection is increased significantly. The socket contact may advantageously be made of relatively soft crimping material, such as copper, for example, since the guide means on the contact pin side generates the contact force needed to produce the frictional engagement.

In an advantageous embodiment, the contact pin is mounted so as to be displaceable along its central longitudinal axis. A compression spring of the plug connector forces the contact pin in the plug-in direction. This advantageously enables the contact pin, once the frictional engagement between the contact bars and the contact pin has been produced, to assume a contact position in which a secure electrical contact is enabled while at the same time potential abrasion in the region of the electrical contact is minimized. Since in the contact position the static friction is greater than or equal to the spring force, the contact pin is advantageously clamped in the contact socket.

In an advantageous embodiment, the guide means is embodied as an annular spring, the annular spring being arranged substantially coaxially to the central longitudinal axis of the contact pin. When the contact bars of the contact socket are introduced, the contact bars are deflected by the annular spring and are forced toward the contact pin, with the annular spring generating the contact force of the contact bars onto the contact pin that is required to produce the frictional engagement.

In an advantageous embodiment, the guide means has an inner diameter which is smaller than an outer diameter of the assigned contact socket of the mating connector. This advantageously enables the contact socket to be guided without friction up to the guide means. To establish contact between the contact socket and the contact pin, the inner diameter of the guide means, which is smaller than the outer diameter of the assigned contact socket, causes the contact bars of the contact socket to be guided toward the contact pin.

In an advantageous embodiment, the contact pin has an outer diameter which is smaller than an inner diameter of the assigned contact socket of the mating connector in the uncontacted state. In this embodiment as well, this dimensioning enables the contact socket to be introduced to the contact pin in a pre-connected position substantially without friction.

Additional features, possible applications and advantages of the invention are contained in the following description of embodiments of the invention, which are depicted in the figures of the set of drawings. In the drawings, all features described or depicted, alone or in any combination, make up the subject matter of the invention, regardless of their combination in the claims or the dependency references thereof, and regardless of the wording used to describe them in the description and their depiction in the set of drawings. The same reference signs are used in all figures to denote functionally equivalent dimensions and features, even in different embodiments.

FIG. 1 shows a schematic cross-sectional view of a plug connector 2 for producing an electrically conductive connection. Plug connector 2 comprises a guide means 4 and a contact pin 6, which are arranged within an insulating body 8. Plug connector 2 is substantially rotationally symmetrical in design around a central longitudinal axis.

Contact pin 6 is mounted so as to be displaceable along central longitudinal axis 10 within insulating body 8. A compression spring 12, which is supported opposite a plug-in direction 14 of plug connector 2 against a section 16 that is stationary in relation to insulating body 8, forces contact pin 6 in plug-in direction 14 of plug connector 2. Opposite plug-in direction 14, in region 18 of contact pin 6, electrical contact with a cable, for example, may be provided. An abutment region 20 of insulating body 8 combined with a corresponding diameter projection 22 of contact pin 6 limits the movement of contact pin 6 in plug-in direction 14.

Contact pin 6 is located in a position in which contact pin 6 is not acted on by force opposite plug-in direction 14. When contact pin 6 is in this pre-connected position, contact pin 6 extends all the way through guide means 4.

In plug-in direction 14, contact pin 6 has an outer diameter 24. The region of contact pin 6 that has outer diameter 24 is positioned together with guide means 4 in a receiving region 26 of insulating body 8.

Guide means 4 is situated in a circumferential inner groove 28 of receiving region 26. Opposite plug-in direction 14 of plug connector 4, guide means 4 has a lead-in chamfer 30, which leads up to inner diameter 32 of guide means 4. Receiving region 26 of insulating body 8 itself has an inner diameter 34. Guide means 4 is embodied as an annular spring and has at least one interruption in the circumferential direction to provide it with the desired elasticity. An outer diameter 36 tapers in plug-in direction 14 to an outer diameter 38.

Figure 2:
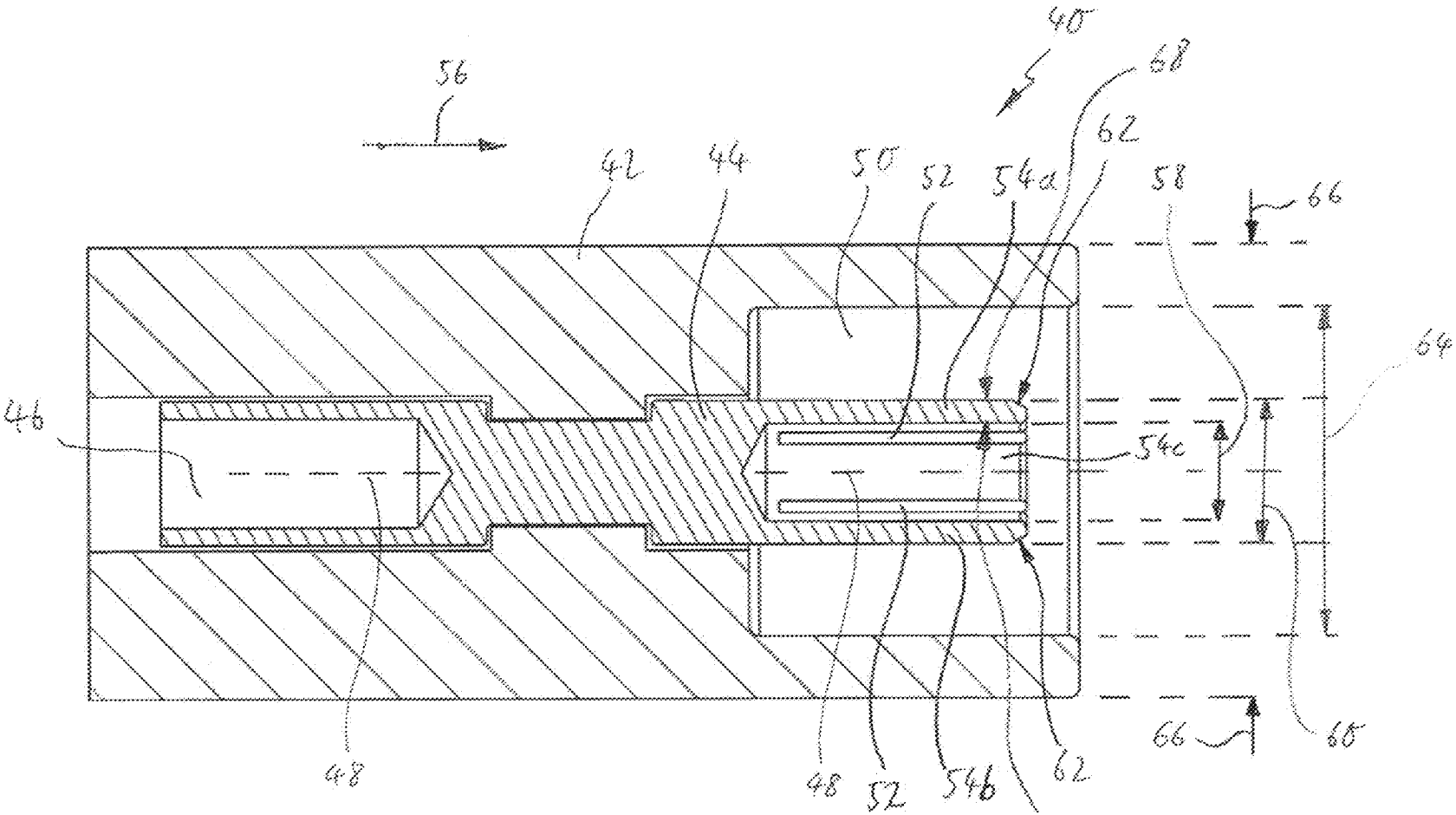
FIG. 2 a schematic cross-sectional view of a mating connector that corresponds to the plug connector of FIG. 1.

FIG. 2 shows a schematic cross-sectional view of a mating connector 40, designed for positioning on plug connector 2. Mating connector 40 has an insulating body 42 and a contact socket 44, which is located in insulating body 42. A region 46 of contact socket 44 is provided for electrical contact with a corresponding cable, for example. Mating connector 40 is configured as substantially concentric around a central longitudinal axis 48. Contact socket 44 has a receiving region 50 that corresponds to insulating body 8.

In receiving region 50, contact socket 44 has contact bars 54, which may be arranged mirror symmetrically to central longitudinal axis 48 and extending substantially parallel to central longitudinal axis 48, said contact bars being interrupted by slots 52. Contact bars 54 point toward a plug-in direction 56 of mating connector 40. In addition, mutually opposite contact bars 54 can be moved toward one another in the direction of central longitudinal axis 48, which movement is also enabled by slots 52. In the region of contact bars 54, contact socket 44 has an inner diameter 58 and an outer diameter 60. Toward their distal end, bars 54 of contact socket 44 each have a lead-in chamfer 62, corresponding to lead-in chamfer 30.

When lead-in chamfer 62 meets lead-in chamfer 30, contact bars 54 are deflected by guide means 4 in the direction of contact pin 6, and guide means 4 applies the contact force necessary to establish electrical contact by friction between contact bars 54 and contact pin 6 and to force contact pin 6 opposite plug-in direction 14. Inner diameter 64 of receiving region 50 is greater than outer diameter 38. Insulating body 42 has an outer diameter 66.

Contact bars 54 each have outer guide sections 68 which, upon reaching guide means 4, force each of contact bars 54 toward central longitudinal axis 48 up to contact pin 6. At the same time, inner contact sections 70 are forced onto contact pin 6, thereby establishing an electrical connection between contact socket 44 and contact pin 6. This separation of guide sections 68 and contact sections 70 prevents any abrasion that occurs in the region of guide sections 68 from adversely affecting the functioning of contact sections 70.

Figure 3:
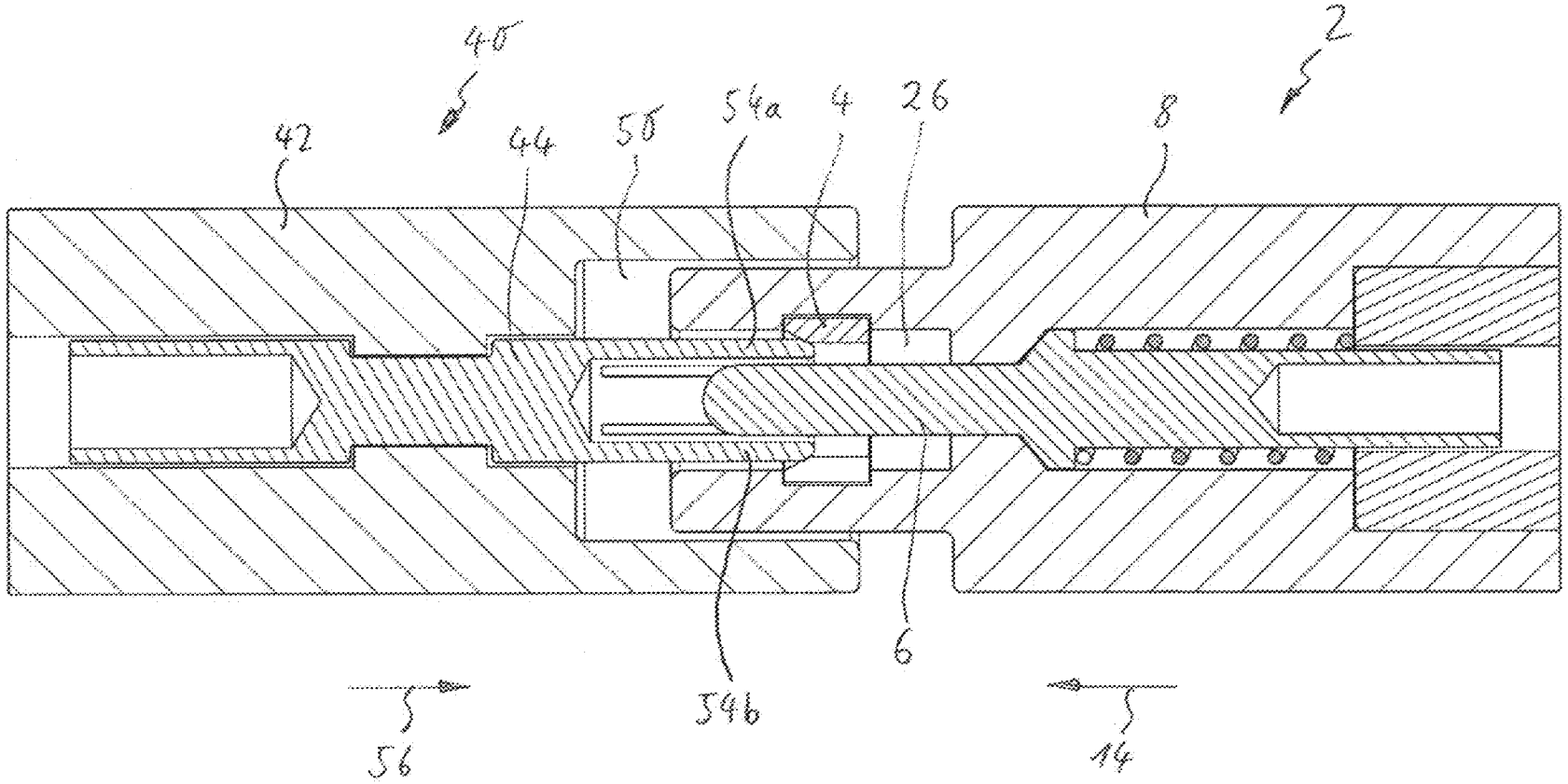
FIG. 3 a schematic cross-sectional view of the plug connector and the mating connector in a pre-connected position.

FIG. 3 shows a schematic cross-sectional view of plug connector 2 and the corresponding mating connector 40 in a pre-connected position. In this pre-connected position, contact bars 54 are introduced substantially parallel to one another onto contact pin 6. At the same time, insulating body 8 engages into receiving space 50 of insulating body 42. Up to the pre-connected position shown, contact pin 6 extends without friction and without contacting up to contact socket 44. At the same time, upon reaching the pre-connected position shown, contact pin 6 is already situated inside contact socket 44.

Figure 4:
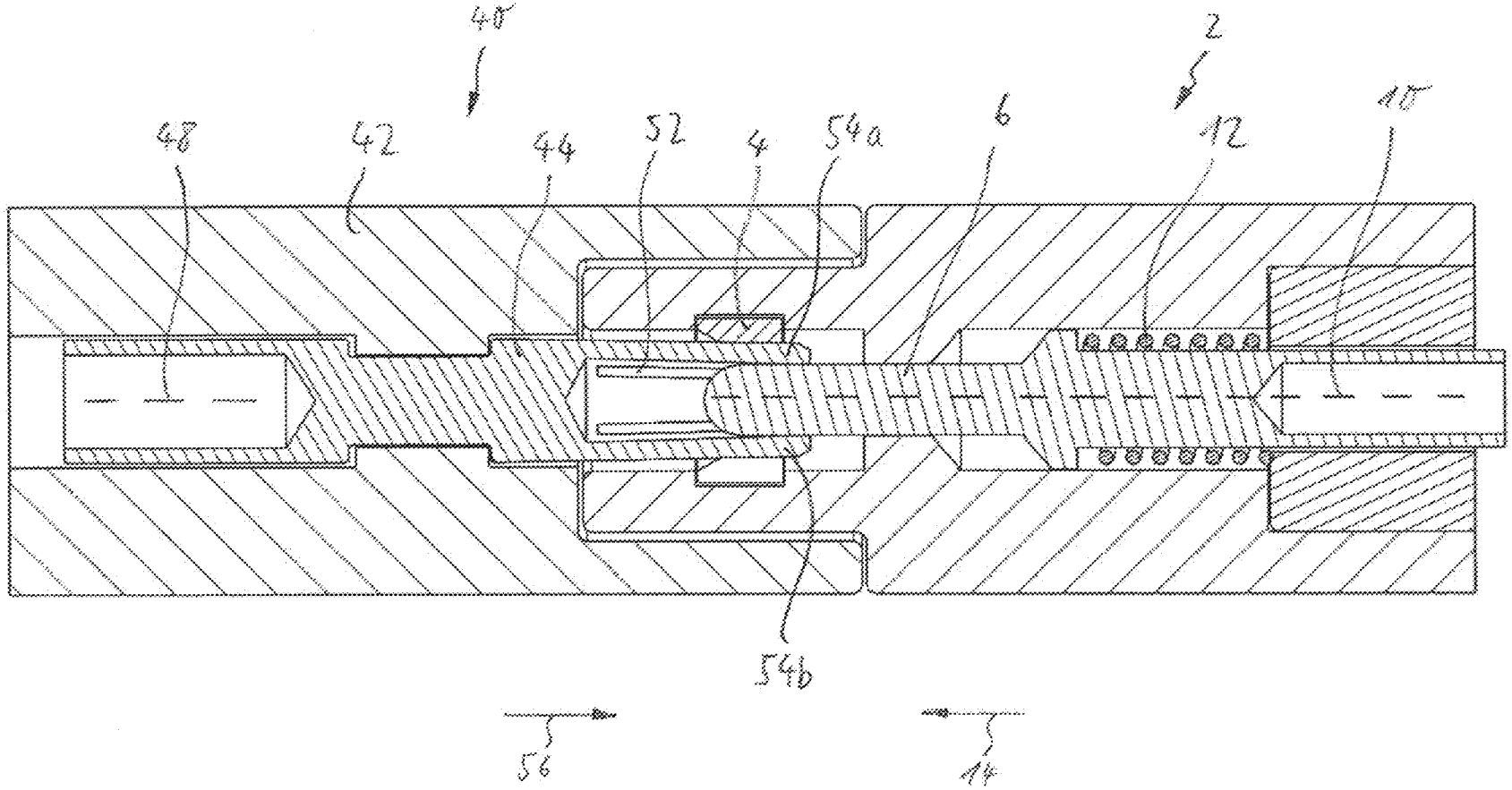
FIG. 4 a schematic cross-sectional view of the plug connector and the mating connector in a connected position.

FIG. 4 shows a schematic cross-sectional view of plug connector 2 and mating connector 40 in a connected position. This figure illustrates the positioning of the individual components of plug connector 2 and mating connector 40 in a contact position. Plug connector 2 and mating connector 40 form a plug connector system for producing the electrically conductive connection.

Proceeding from the pre-connected position shown in FIG. 3, in FIG. 4 plug connector 2 and mating connector 40 have been moved further toward one another, causing contact bars 54 to be guided toward central longitudinal axis 10 or 48 and to thereby encompass contact pin 6 in frictional engagement. As a result of this frictional engagement, contact socket 44 forces contact pin 6 opposite plug-in direction 14, thereby compressing compression spring 12. Contact bars 54 thus encompass contact pin 6 in frictional engagement and establish contact with contact pin 6 by means of inner contact sections 70.

In the embodiment shown in FIGS. 1 to 4, contact pin 6 is mounted movably in plug connector 2. In contrast, contact socket 44 is stationary in mating connector 40.

The invention claimed is:

1. A plug connector for positioning on a mating connector and for producing an electrically conductive connection, the plug connector comprising:

a guide element; and a contact pin;

wherein the guide element is configured and positioned to produce the electrically conductive connection, a plurality of contact bars of a contact socket of the mating connector being arranged to be guided toward the contact pin via the guide element, said contact bars encompassing the contact pin in frictional engagement to establish electrical contact, wherein the guide element is embodied as an annular spring, wherein the guide element has at least one interruption in a circumferential direction, and wherein the annular spring is disposed substantially coaxially to the central longitudinal axis of the contact pin.

2. The plug connector according to claim 1, wherein the contact pin is mounted so as to be displaceable along its central longitudinal axis, and wherein a compression spring of the plug connector biases the contact pin in a plug-in direction of the plug connector.

3. The plug connector according to claim 1, wherein the guide element has an inner diameter which is smaller than an outer diameter of the assigned contact socket of the mating connector.

4. The plug connector according to claim 1, wherein the contact pin has an outer diameter that is smaller than an inner diameter of the assigned contact socket of the mating connector in the uncontacted state.

5. A mating connector for positioning on a plug connector and for producing an electrically conductive connection, the mating connector comprising:

a contact socket having at least two contact bars, wherein the at least two contact bars are configured and arranged to produce the electrically conductive connection, the contact bars being guided toward a contact pin of the plug connector via a guide element of the plug connector, said contact bars encompassing the contact pin in frictional engagement to establish electrical contact, wherein the guide element is embodied as an annular spring, wherein the guide element has at least one interruption in a circumferential direction, and wherein the annular spring is disposed substantially coaxially to the central longitudinal axis of the contact pin.

6. The mating connector according to claim 5, wherein the contact bars are configured and arranged such that the contact bars, which are introduced to the guide element, which is embodied as an annular spring and is disposed substantially coaxially to the central longitudinal axis of the contact pin, are forced toward the contact pin.

7. The mating connector according to claim 5, wherein in the uncontacted state, the contact socket has an inner diameter that is greater than an outer diameter of the assigned contact pin of the plug connector.

8. The mating connector according to claim 7, wherein the contact bars are configured and arranged such that the contact bars, which are introduced to the guide element, which is embodied as an annular spring and is disposed substantially coaxially to the central longitudinal axis of the contact pin, are forced toward the contact pin.

9. The mating connector according to claim 5, wherein the contact bars are arranged coaxially to the central longitudinal axis of the contact socket, and wherein the outer diameter of the contact socket is greater than an inner diameter of the assigned guide element of the plug connector.

10. The mating connector according to claim 9, wherein in the uncontacted state, the contact socket has an inner diameter that is greater than an outer diameter of the assigned contact pin of the plug connector.

11. The mating connector according to claim 9, wherein the contact bars are configured and arranged such that the contact bars, which are introduced to the guide element, which is embodied as an annular spring and is disposed substantially coaxially to the central longitudinal axis of the contact pin, are forced toward the contact pin.

12. The mating connector according to claim 5, wherein the contact socket is configured and positioned such that the contact pin of the plug connector, which is mounted so as to be displaceable along its central longitudinal axis in the plug connector and is forced via a compression spring in the plug-in direction, assumes a contact position with respect to the plug connector once the frictional engagement between the contact bars and the contact pin has been established.

13. The mating connector according to claim 12, wherein the contact bars are arranged coaxially to the central longitudinal axis of the contact socket, and wherein the outer diameter of the contact socket is greater than an inner diameter of the assigned guide element of the plug connector.

14. The mating connector according to claim 12, wherein in the uncontacted state, the contact socket has an inner diameter that is greater than an outer diameter of the assigned contact pin of the plug connector.

15. The mating connector according to claim 12, wherein the contact bars are configured and arranged such that the contact bars, which are introduced to the guide element, which is embodied as an annular spring and is disposed substantially coaxially to the central longitudinal axis of the contact pin, are forced toward the contact pin.

16. A plug connector system for producing an electrically conductive connection, the plug connector system comprising:

a plug connector comprising a guide element and a contact pin; and a mating connector for positioning on the plug connector and for producing an electrically conductive connection with the plug connector, the mating connector comprising a contact socket having at least two contact bars;

wherein the guide element of the plug connector is configured and positioned to produce an electrically conductive connection with the mating connector, at least two of the contact bars of the contact socket of the mating connector being configured and arranged to be guided toward the contact pin via the guide element, the contact bars encompassing the contact pin in frictional engagement to establish electrical contact, wherein the guide element is embodied as an annular spring, wherein the guide element has at least one interruption in a circumferential direction, and wherein the annular spring is disposed substantially coaxially to the central longitudinal axis of the contact pin.

17. The plug connector system of claim 16, wherein, with regard to the plug connector:

the contact pin is mounted so as to be displaceable along its central longitudinal axis, and wherein a compression spring of the plug connector biases the contact pin in a plug-in direction of the plug connector; and the guide element is embodied as an annular spring, and wherein the annular spring is disposed substantially coaxially to the central longitudinal axis of the contact pin.

18. The plug connector system of claim 17 wherein, with regard to the mating connector, the contact socket is configured and positioned such that the contact pin of the plug connector, which is mounted so as to be displaceable along its central longitudinal axis in the plug connector and is forced via a compression spring in the plug-in direction, assumes a contact position with respect to the plug connector once the frictional engagement between the contact bars and the contact pin has been established.

19. The plug connector system of claim 18 wherein the contact bars are configured and arranged such that the contact bars, which are introduced to the guide element, which is embodied as an annular spring and is disposed substantially coaxially to the central longitudinal axis of the contact pin, are forced toward the contact pin.

* * * * *